US006688249B1

(12) United States Patent
Klein Breteler et al.

(10) Patent No.: US 6,688,249 B1
(45) Date of Patent: Feb. 10, 2004

(54) METHOD AND APPARATUS FOR MOUNTING OR DISMOUNTING A SEMI-AUTOMATIC TWIST-LOCK

(75) Inventors: Antonius Johannes Klein Breteler, Delft (NL); Gürbüz Tekeli, Harderwijk (NL)

(73) Assignees: Technische Universiteit Delft, Delft (NL); Nelcon B.V., Rotterdam (NL)

( * ) Notice: Subject to any disclaimer, the term of this patent is extended or adjusted under 35 U.S.C. 154(b) by 0 days.

(21) Appl. No.: 10/048,756

(22) PCT Filed: Jul. 26, 2000

(86) PCT No.: PCT/NL00/00532

§ 371 (c)(1),
(2), (4) Date: May 21, 2002

(87) PCT Pub. No.: WO01/12469

PCT Pub. Date: Feb. 22, 2001

(30) Foreign Application Priority Data

Aug. 18, 1999 (NL) ..... 1012849

(51) Int. Cl.[7] ..... B63B 25/08
(52) U.S. Cl. ..... 114/75; 414/140.3; 414/141.3
(58) Field of Search ..... 114/72, 73, 75; 410/77, 82, 83; 212/325; 24/287; 414/139.9, 140.1, 140.3, 141.3, 809; 294/141, 142, 143

(56) References Cited

U.S. PATENT DOCUMENTS 3,952,891 A 4/1976 Terayama et al.
6,435,361 B2 * 8/2002 Franzen et al. ..... 212/325

FOREIGN PATENT DOCUMENTS

| | | | | |
|---|---|---|---|---|
| DE | 4317996 A1 | | 5/1993 | |
| DE | 19546606 A1 | | 6/1997 | |
| DE | 29719466 U1 | * | 4/1998 | ..... B65C/1/04 |
| JP | 58116292 A | * | 7/1983 | ..... B63B/25/00 |
| JP | 59213591 A | * | 12/1984 | ..... B63B/25/00 |
| JP | 63008094 A | * | 1/1988 | ..... B63B/25/00 |
| JP | 01069407 A | * | 3/1989 | ..... B65G/1/04 |
| JP | 01209223 A | * | 8/1989 | ..... B65G/63/00 |
| JP | 01321294 A | * | 12/1989 | ..... B66C/1/10 |
| WO | WO96/15053 A1 | | 5/1996 | |

* cited by examiner

*Primary Examiner*—S. Joseph Morano
*Assistant Examiner*—Ajay Vasudeva
(74) *Attorney, Agent, or Firm*—Jeffrey D. Myers

(57) ABSTRACT

The invention relates to a fully automated, or a semi-automated, method for mounting or dismounting a semi-automatic twistlock at a corner of a deck container, wherein the twistlock is mounted or dismounted on a quayside where a ship may be docked for loading or unloading, in a loading or unloading terminal installed on the quayside, the deck container being placed by means of the quay crane on a trolley bearing the deck container. The trolley carrying the deck container is brought into the loading or unloading terminal, which loading or unloading terminal is installed outside the operating area of the quay crane. The deck container is lifted off the trolley, after which an implementation apparatus is activated for mounting or dismounting the twistlock. Subsequent to this operation having been carried out, the deck container is replaced on the trolley and the trolley leaves the loading or unloading terminal.

9 Claims, 5 Drawing Sheets

METHOD AND APPARATUS FOR MOUNTING OR DISMOUNTING A SEMI-AUTOMATIC TWIST-LOCK

CROSS-REFERENCE TO RELATED APPLICATIONS

This application is a national entry application of International Patent Application Serial No. PCT/NL00/00532, entitled "Method and Apparatus for Mounting or Dismounting a Semi-Automatic Twist-Lock" to A. J. Klein Breterler, et al., having an international filing date of Jul. 26, 2000, and claiming priority to Netherlands Patent Application Serial No. 1012849, having a filing date of Aug. 18, 1999, and the specifications thereof are incorporated herein by reference.

STATEMENT REGARDING FEDERALLY SPONSORED RESEARCH OR DEVELOPMENT (Not Applicable)

INCORPORATION BY REFERENCE OF MATERIAL SUBMITTED ON A COMPACT DISK OR MICROFICHE APPENDIX (Not Applicable)

BACKGROUND OF THE INVENTION

1. Field of the Invention

The invention firstly relates to a method for mounting or dismounting a semi-automatic twistlock at a corner of a container, wherein the twistlock is mounted or dismounted on a quayside where a ship may be docked for loading or unloading.

The invention also relates to a loading or unloading terminal to be used with such a method.

2. Description of Related Art

A twistlock such as, for example, disclosed in the international patent application WO 96/15053 (PCT/SE 95/01337), serves to secure containers of the kind transported on sea-going ships against moving and going overboard. Since its introduction at the beginning of the seventies of the 20th century, different variants of the twistlock have been brought on the market. The original variants were operated completely manually, whereas nowadays the so-called semi-automatic type is used more and more.

A twistlock consists of a housing, an operating handle and two cones, which have to intermate with the containers, and which have to interlock the stacked containers. The two cones of the twistlocks are attached to an axis that is rotatable in the housing.

In the prior art a semi-automatic twistlock is mounted as follows: After a container has been placed under a quayside crane, the crane driver lifts the container by means of the crane and veers it to approximately 1.5 m above the ground in the vicinity of two persons who mount the twistlocks. Each of these persons walks with a twistlock in the hand to a corner of the container, inserts said twistlock into the respective recess and moves the operating handle such that the twistlock is locked into place. The same operation has to be carried out for the two remaining corners of the container. After this has been done, the crane driver transports the container to the ship. The semi-automatic embodiment of the twistlock ensures that the same interlocks automatically with the other container onto which the respective container is placed.

To release, each twistlock has to be unlocked manually on deck such as to release the lock with the container underneath. The twistlocks coupled to the top containers then have to be dismounted in the reverse order to that described above for mounting.

This known method of operation has the following drawbacks: There are many kinds of semi-automatic twistlocks in use which means that the quayside crew requires and continues to require a considerable amount of instruction and training. In addition, mounting and dismounting the twistlocks is heavy and unpleasant work. Each twistlock weighs approximately 7 to 8 kg and in order to mount it, it needs to be lifted from a bin standing on the ground and inserted at a height of approximately 1.5 m. Apart from the fact that this is heavy and unpleasant work which has to be carried out in all weathers, it is also dangerous because the work has to be done under the crane from which the container is suspended and on the traffic lanes intended for the vehicles transporting the containers to and from the loading site. A further serious drawback is that these operations prolong the crane cycle of the crane loading and unloading the ship, which has a negative effect on the crane's performance, while also raising the moorage fee for the ships to be loaded and unloaded.

DE-A-43 17 996 discloses a method and an apparatus for mounting or dismounting a semi-automatic twistlock at a corner of a container, wherein the twistlock is mounted or dismounted in a loading or unloading terminal installed on the quayside where a ship may be moored that is to be loaded or unloaded, the container being placed by means of the quay crane on a trolley bearing the container. Said trolley used in DE-A-43 17 996 is provided with features for operating the twistlock. A quay crane places the containers to be handled on the trolley and after operating the twistlock, a straddle carrier is needed to move the respective container. The drawback of the method and apparatus known from DE-A-43 17 996 is that a separate loading or unloading terminal is needed for every quay crane, while its dimensions need to be adjusted to the dimensions of the containers. Another drawback is that the operation of the loading or unloading terminal influences the cycle of the quay crane which, among other things, is disadvantageous in the event of malfunction. A further disadvantage is that the prior art loading or unloading terminal has to be moved together with the quay crane and moreover, that as a consequence, the operating crew stays continuously in the danger zone.

BRIEF SUMMARY OF THE INVENTION

It is the object of the invention to provide a method and apparatus wherein said drawbacks do not occur, or are at least greatly reduced. To this end the method according to the invention is characterized in that the container is lifted off the trolley, after which an implementation apparatus is activated for mounting or dismounting the twistlock, and in that subsequent to this operation having been carried out, the container is replaced on the trolley and the trolley leaves the loading or unloading terminal.

This method may be realized especially well in a loading or unloading terminal which is embodied as a portal under which the container carried by the trolley may be placed, which portal is provided with a lifting device for lifting the container off the trolley, and which has at least one implementation apparatus for mounting or dismounting a twistlock at a corner of the container, which implementation apparatus possesses a holder for the twistlock, which holder comprises a clamping member for a housing of the twistlock and a rotating member for rotating a cone of the twistlock, and which is characterized in that the carrier member is placed on a transport device guided along the container. The carrier member is preferably embodied with arms forming a parallelogram whose first ends are coupled with the transport device and whose second ends are coupled with the holder.

This has the advantage that on the one hand the implementation apparatus can be kept substantially outside the path followed by the container and on the other hand, that this equips the carrier member for positioning the holder under a corner of a container as well as above a supply tray, while the apparatus can be used for containers of diverse dimensions.

A further desirable embodiment of the loading and unloading apparatus according to the invention is characterized in that the holder is adjustable to a first position with the twistlock pointing upward, and a second position with the twistlock pointing downward. In this manner a simple movement suffices to change the position in which the twistlock is being mounted on or dismounted from the container, and the position in which the twistlock is taken to or from the supply tray.

In the terminal according to the invention it is possible to provide fully automated mounting and dismounting of semi-automatic twistlocks. The advantage that the invention affords in addition to the improvement regarding safety, is in particular the fact that the method and the apparatus may be employed outside the actual crane area, so that any hindrance to the crane cycle is avoided altogether. Alternatively, instead of operating the loading or unloading terminal fully automated, it is also possible to operate it such as to be semi-automated and, as the occation arises, to mount or dismount the twistlock manually. The full advantage resulting from an unhindered crane cycle is then retained, however, the gain in safety is at least partially forfeited.

Advantageously the loading or unloading terminal is equipped such that four implementation apparatuses are provided for simultaneously mounting or dismounting four twistlocks at the four corners of the container. This is advantageous for the optimization of the processing capacity of the loading or unloading terminal.

In a preferred embodiment the loading or unloading terminal is thus designed such that the portal is mobile. This is a convenient manner of adapting the processing position of the loading or unloading terminal to the prevailing conditions on the quayside.

It is desirable for the trolley to be provided near its corners with recesses for the accommodation of the twistlocks mounted at the corners of the container. This allows the container to be replaced on the trolley after the twistlocks have been mounted.

Another advantage is for each implementation apparatus to have in close proximity a supply tray for twistlocks. This ensures that there is a regulated stock of twistlocks, and the supply trays can serve as storage place.

BRIEF DESCRIPTION OF THE SEVERAL VIEWS OF THE DRAWINGS

The invention will now be a further elucidated with reference to the drawings, which in FIG. 1, show the method according to the prior art.

Similar parts in the Figures are indicated by identical reference numbers.

DETAILED DESCRIPTION OF THE INVENTION

Figure 1:
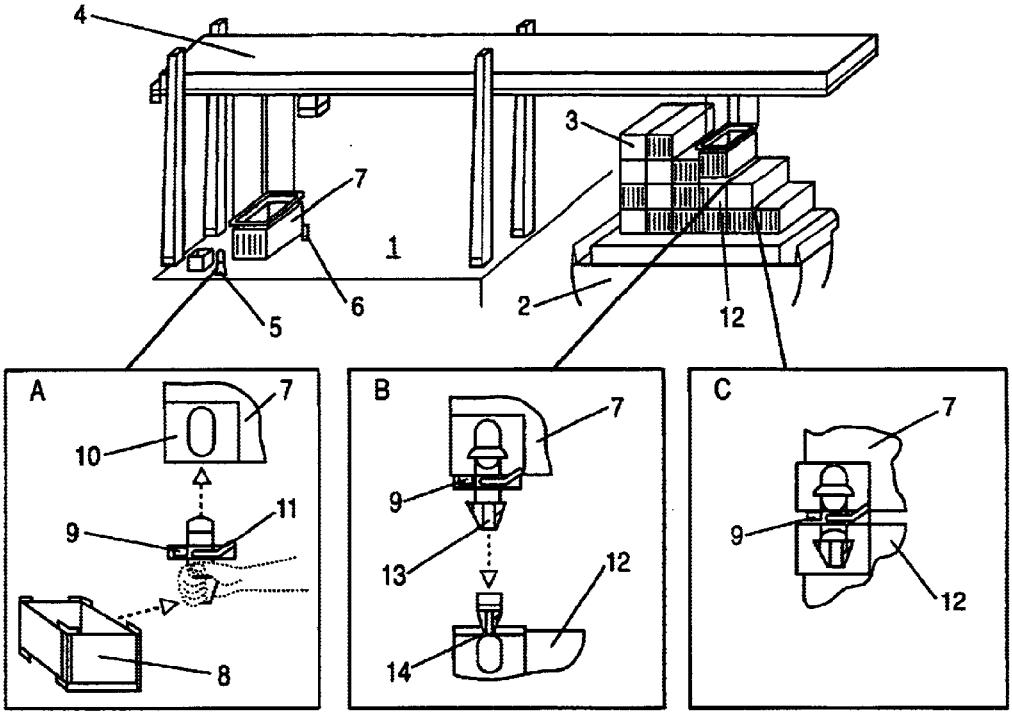
FIG-1 PRIOR ART
Figure 2:
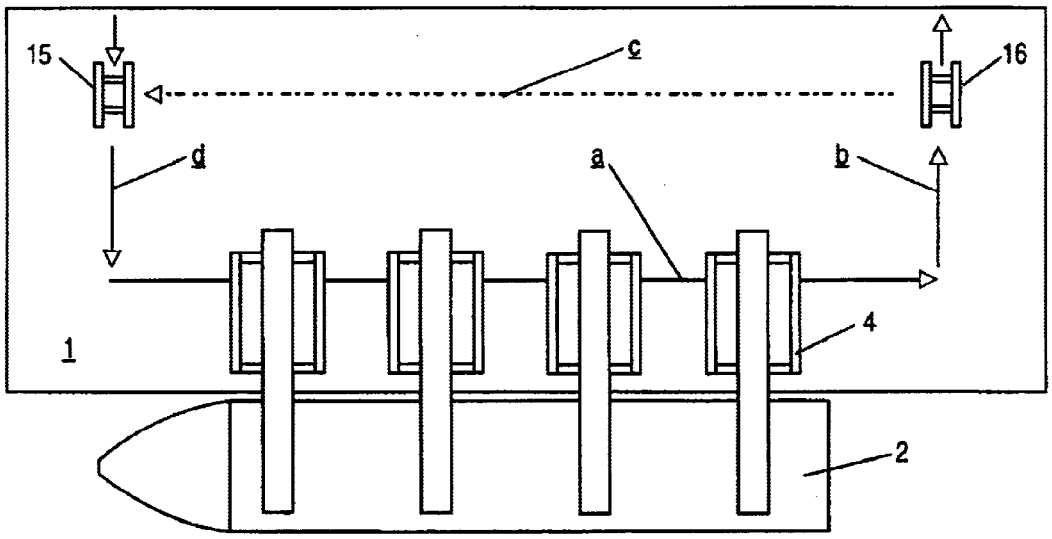
in FIG. 2, schematically show the method and the apparatus used therewith according to the invention.

Referring first to FIG. 1, an outline is shown of the prior art method for mounting or dismounting a semi-automatic twistlock at a corner of a container. The Figure shows a quayside 1 at which a ship 2 is moored, laden with containers 3. Said containers 3 are transported to or from the ship 2 by means of a portal crane 4. For the purpose of loading the ship 2, two persons 5 and 6 are present on the quayside 1 who provide a container 7 with a twistlock. A detail is shown in a Sub-figure A. Herein it is shown that the twistlock 9 coming from a supply bin 8 is mounted manually into a corner 10 at the underside of a container 7. To this end the operating persons 5 and 6 have to insert the twistlock 9 at a height of approximately 1.5 m into the respective recess of a corner 10 and subsequently turn the handle 11 of the twistlock 9 to effectuate interlocking. Sub-figure B shows that the container 7 with the interlocked twistlock 9 is raised onto another container 12 such that a cone 13 of the twistlock 9 will fit into a recess 14 at a corner of the container 12. Further veering out of the crane from which the container 7 is suspended, completes the interlocking with the container 12 thereunder, as shown in Sub-figure C. When the ship 2 is unloaded, the twistlocks 9 have to be unlocked from the containers 12 thereunder. This is done manually on deck of the ship 2. After this has been carried out, various operations as described above for the mounting of the twistlock 9 are performed in the reverse order.

The invention will now be elucidated with further reference to the FIGS. 2 to 6,:

In the invention use is made of a loading terminal 15 or an unloading terminal 16, which may optionally be combined, for the mounting or dismounting of a semiautomatic twistlock at a corner of a containers. The loading or unloading terminal or 15, 16 is embodied as portal 17—see FIG. 3—under which the container 3, 7, 12 which is placed on a trolley 18, may be positioned. The portal 17 is provided with a schematically indicated lifting apparatus 19, for lifting the container 3, 7, 12 off the trolley. Further an implementation apparatus is provided, elucidated hereinbelow, for mounting or dismounting a twistlock 9 at a corner 10, 14 of the container 3, 7, 12. The loading terminal 15 and the unloading terminal 16 are completely separate from the other facilities on the quayside 1, as can be clearly seen in FIG. 2. Preferably the loading or unloading terminal 15, 16 is provided with four implementation apparatuses, for simultaneously mounting or dismounting the necessary twistlock on the four corners of the container 3, 7, 12. This is not shown in the Figures, but is completely obvious to the person skilled in the art.

Figure 3:
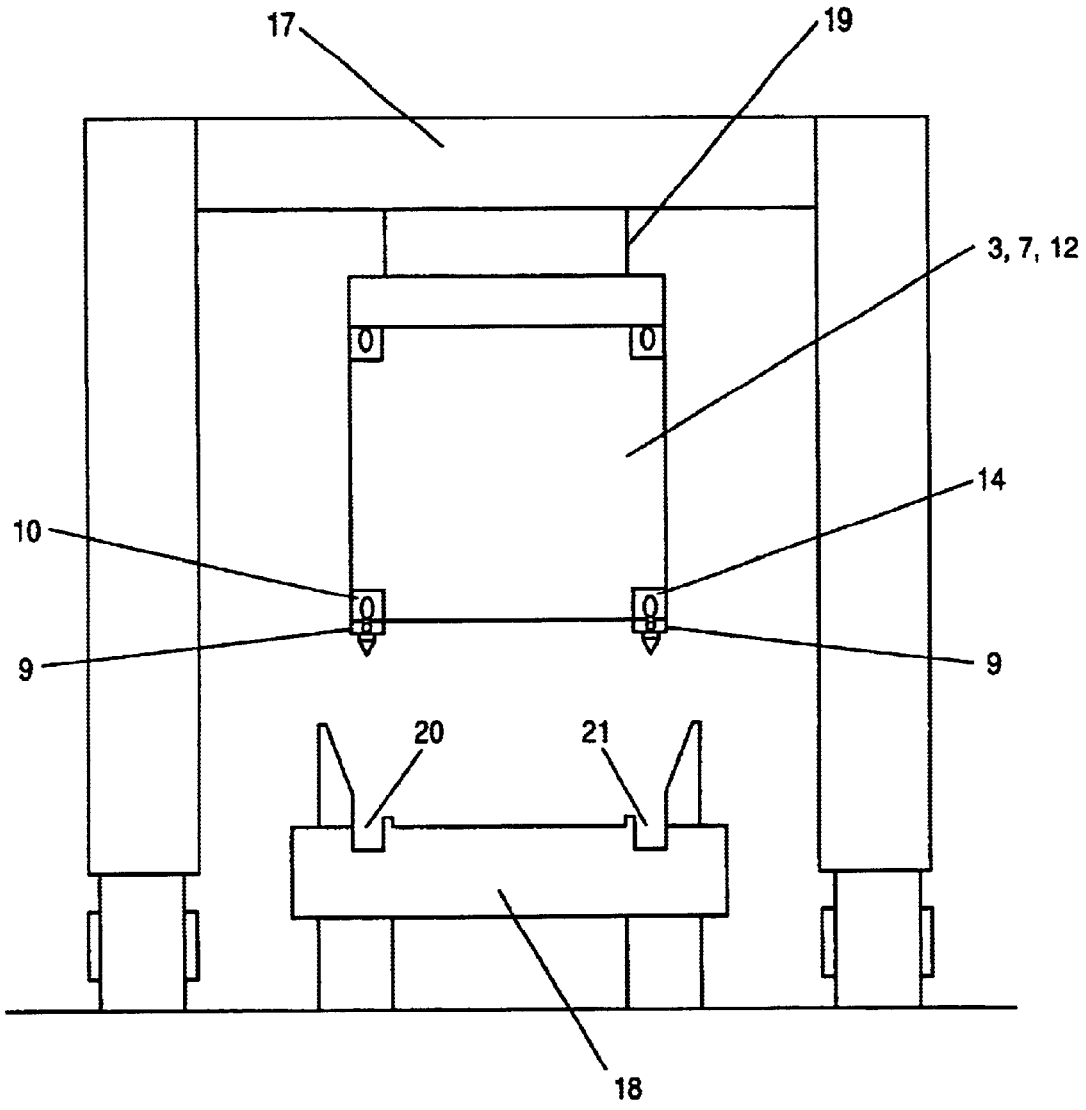
in FIG. 3, show a schematic view of the loading or unloading terminal according to the invention.

FIG. 3 shows an embodiment in which the portal 17, is mobile. The trolley 18 will, for example, substantially follow the trajectory indicated in FIG. 2 by the arrows A, B, C and D. FIG. 3 further shows that near its corners, the trolley 18 is provided with recesses 20, 21 for the accommodation of the twistlocks 9 mounted at the corners of the containers 3, 7, 12.

Figure 4:
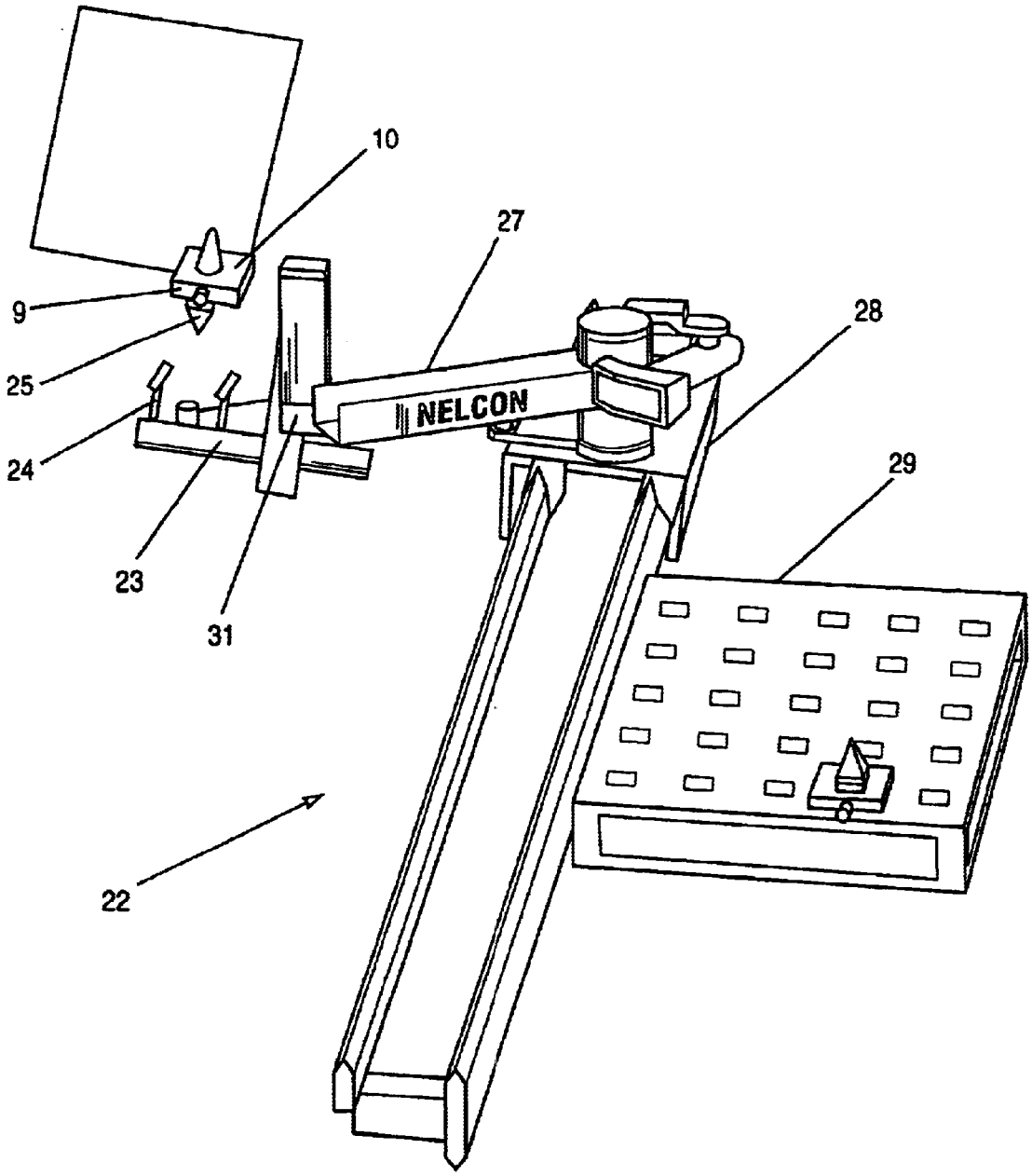
in FIG. 4, show an implementation apparatus which is part of the loading or unloading terminal according to the invention.
Figure 5:
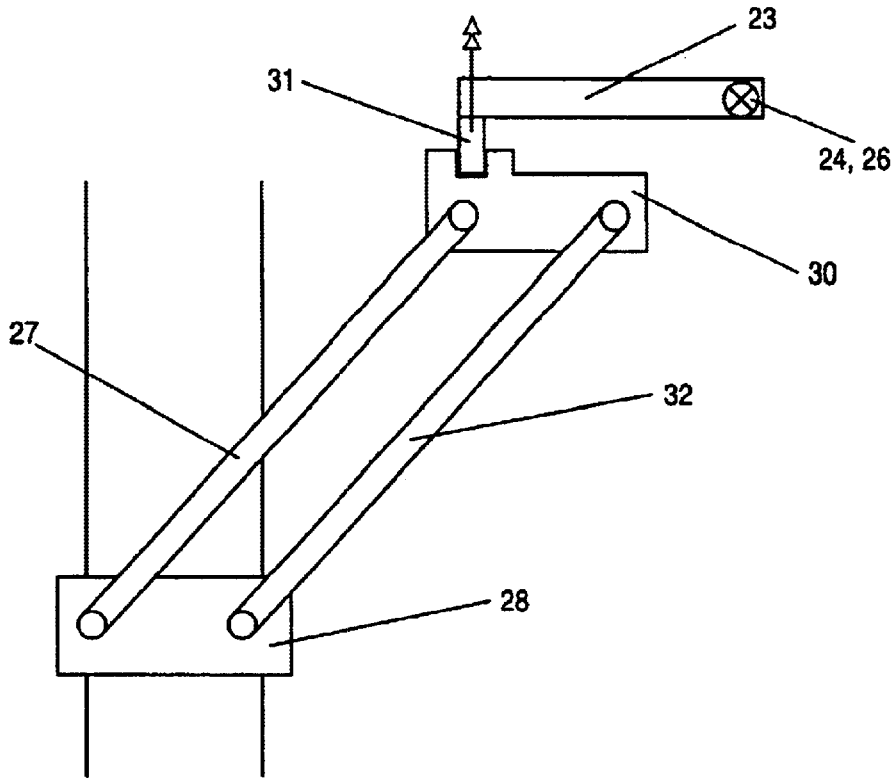
in FIG. 5, show the kinetic graph of the carrier member that forms part of the implementation apparatus according to the invention; and in FIG. 6, show a preferred embodiment of a suitable form of the rotation member of the implementation apparatus according to the invention.

FIG. 4, shows an implementation apparatus to be used in the loading and unloading apparatus 15, 16. Said implementation apparatus is generally indicated by reference number 22 and comprises a supply tray 29 for the twistlocks 9, placed in the vicinity of said apparatus. Such an implementation apparatus 22 preferably comprises a holder 23 for the twistlock 9, which holder 23 possesses a clamping member 24 for a housing of the twistlock 9, and a rotation member (not shown) for the rotation of a cone 25 of the twistlock. This also rotates the opposite cone projecting into a corner of the container 3, 7, 12, in order to allow interlocking of the respective corner of the container to be effectuated. The holder 23 is further placed on a carrier member 27, 32 which in turn is placed on a transport device 28, guided along the container 3, 7, 12. The holder is preferably placed on the connecting rod 30 of a parallelogram mechanism having arms 27 and 32, the kinematic graph of which is shown in FIG. 5. The opposite side of the connecting rod 30 is integrated with the carrier device 28 guided along the longitudinal direction of the container. The advantage of this embodiment is that while the parallelogram mechanism is moving, the holder will maintain a same orientation, so that a controlled mounting of the twistlock can take place. The holder 23 is further adjustable to a first position as shown in FIG. 4, with the twistlock 9 directed upward. This position allows the twistlock 9 to be placed in the respective corner of the container 3, 7, 12. Further, the holder 23 is adjustable to a second position, with the twistlock 9 being directed downward, allowing the twistlock 9 to be placed on or removed from the supply tray 29.

In a preferred embodiment as shown in the FIGS. 4 and 5, the holder 23 possesses an arm capable of moving substantially vertically in relation to the connecting rod 30 along a guide 31. The holder is adjustable between the two operating positions by rotating the entire holder 23 in relation to the guide part 31. To actually effectuate the insertion or the removal of a twistlock 9, it is only necessary to control the movement along said vertical guide 31. In order to prevent any interference between the vertical guide and the container in their respective work areas, the clamping member 24 and the rotation member 26 are positioned eccentrically on the holder arm 23, so that any danger of collision between these two objects is avoided. A second advantage of the eccentric positioning is that the working area of the parallelogram mechanism is enlarged, permitting a reduction in the length of the rods 27 and 32.

Figure 6:
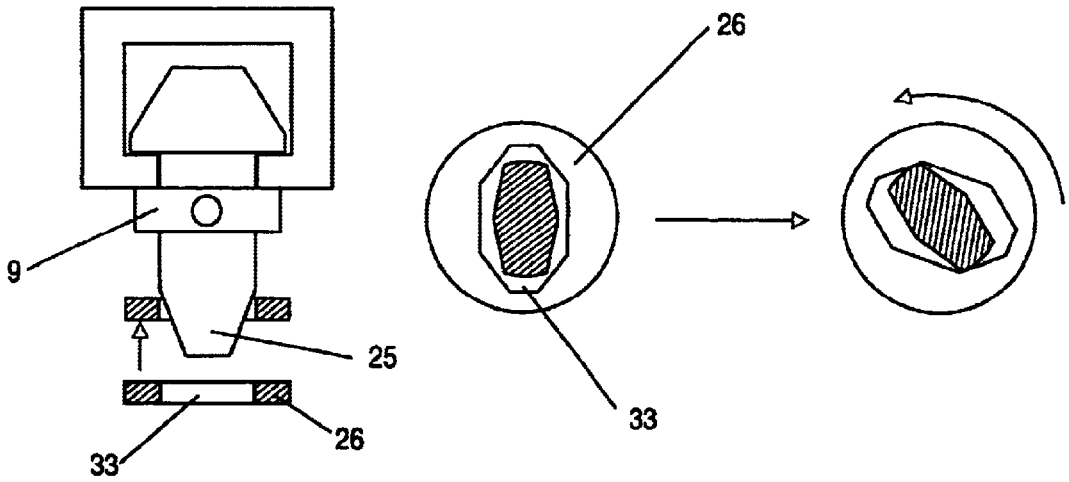
Figure 7:
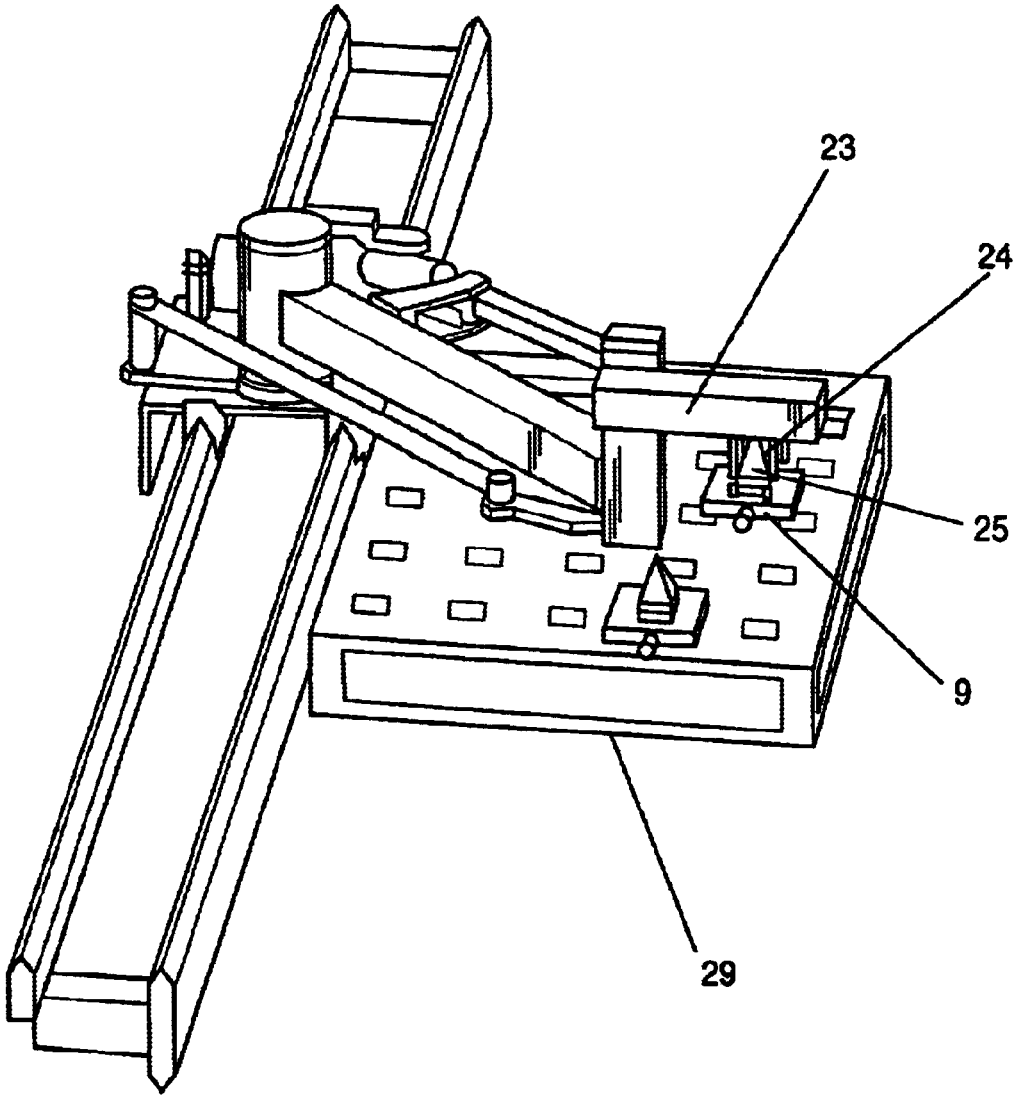
in FIG. 7, show an implementation apparatus of FIG. 4 with the holder adjusted to a second position with the twistlock pointed downward.

FIG. 6, shows a desirable embodiment of the rotation member. As the holder 23 is moved upward (see FIG. 5), the lower cone 25 of the twistlock 9 is inserted into a recess 33 of the rotation member 26. Due to the fact that the cross section of the cone 25 is non-round, the recess 33 can be made such that virtually all cone variants are adequately enclosed to allow the rotational movement to be a transferred from the rotation member 26 to the cone 25.

What is claimed is:

1. A method for mounting or dismounting a semi-automatic twistlock at a corner of a container on a quayside for docking a ship for loading or unloading, wherein the twistlock is mounted or dismounted in a loading or unloading terminal installed on the quayside, the container, being placed by means of a quay crane on a trolley carrying the container, is brought into the loading or unloading terminal, the container is lifted off the trolley, after which an implementation apparatus is activated for mounting or dismounting the twistlock, and subsequent to this operation having been carried out, the container is replaced on the trolley and the trolley leaves the loading or unloading terminal, which loading or unloading terminal is installed outside an operating area of the quay crane.

2. A method according to claim 1, wherein four implementation apparatuses are provided for simultaneously mounting or dismounting four twistlocks at four corners of the container.

3. A method according to claim 1 wherein the twistlocks are supplied to the implementation apparatus by, or placed near the respective implementation apparatus on, a supply tray.

4. A loading or unloading terminal for mounting or dismounting a semi-automatic twistlock at a corner of a container, embodied as a portal under which the container carried by a trolley is placed, which portal is provided with a lifting device for lifting the container off the trolley, and provided with at least one implementation apparatus for mounting or dismounting the twistlock at the corner of the container, which implementation apparatus possesses a holder for the twistlock, which holder comprises a clamping member for a housing of the twistlock and a rotation member for rotating a cone of the twistlock, wherein the holder is placed on a carrier member and the carrier member is placed on a transport device guided along the container, and wherein the loading or unloading terminal is installed outside an operating area of a quay crane.

5. A loading or unloading terminal according to claim 4, wherein the carrier member is embodied with arms forming a parallelogram, whose first ends are coupled with the transport device and whose second ends are coupled with the holder.

6. A loading or unloading terminal according to claim 4 wherein the holder is adjustable to a first position with the twistlock pointing upward, and a second position with the twistlock pointing downward.

7. A loading or unloading terminal according to claim 4 wherein four implementation apparatuses are provided for simultaneously mounting or dismounting four twistlocks at the four corners of the container.

8. A loading or unloading terminal according to claim 4, wherein the trolley is provided near its corners with recesses for the accommodation of the twistlocks mounted at the corners of the container.

9. A loading or unloading terminal according to claim 4, wherein each implementation apparatus has in close proximity a supply tray for twistlocks.

* * * * *